United States Patent [19]

Annand

[11] Patent Number: 5,058,225

[45] Date of Patent: Oct. 22, 1991

[54] INFLATABLE MATTRESS, CHANGEABLE TO CHAIR

[75] Inventor: Brian S. Annand, Alhambra, Calif.

[73] Assignee: International Leisure Products, Inc., Van Nuys, Calif.

[21] Appl. No.: 540,903

[22] Filed: Jun. 20, 1990

[51] Int. Cl.[5] ..... A47C 27/08; A47C 27/10

[52] U.S. Cl. ..... 5/449; 5/455; 297/DIG. 3

[58] Field of Search ..... 5/449, 455, 450, 457, 5/458; 297/DIG. 3

[56] References Cited

U.S. PATENT DOCUMENTS

| | | | |
|---|---|---|---|
| 2,623,574 | 12/1952 | Damsch | 297/455 |
| 2,982,341 | 5/1961 | Besser | 5/458 |
| 3,265,438 | 8/1966 | Regan et al. | 297/456 |
| 3,420,574 | 1/1969 | Smith | 297/574 |
| 3,513,489 | 5/1970 | Miller et al. | 5/449 |
| 3,572,836 | 3/1971 | Khanh | 297/456 |
| 3,584,914 | 6/1971 | Williams | 297/456 |
| 3,610,689 | 10/1971 | Smith | 297/456 |
| 3,696,449 | 10/1972 | Smith | 297/DIG. 3 |
| 3,751,739 | 8/1973 | Assmann | 5/12 R |
| 3,936,969 | 2/1976 | Richard | 297/DIG. 3 |
| 4,136,412 | 1/1979 | Wilhelm | 5/455 |
| 4,459,714 | 7/1984 | Lin | 5/455 |
| 4,905,332 | 3/1990 | Wang | 5/455 |

*Primary Examiner*—Alexander Crosz

*Attorney, Agent, or Firm*—Spensley Horn Jubas & Lubitz

[57] ABSTRACT

An inflatable cushion which can be alternately configured as a mattress or a chair. The cushion includes an inflatable elongate backing member having opposing ends and an inflatable pillow. To form a chair, the opposing ends of the backing member are coupled to form an enclosure which serves as the back and sides of a chair. The pillow is fit within the enclosure to serve as a chair seat. When the opposing ends of the backing member are uncoupled, the backing member is generally planar and forms a mattress. The pillow serves as a headrest.

7 Claims, 1 Drawing Sheet

INFLATABLE MATTRESS, CHANGEABLE TO CHAIR

BACKGROUND OF THE INVENTION

1. Field of the Invention

The present invention relates to an inflatable cushion, in particular, to an inflatable cushion which can be alternately configured as either a mattress or a chair.

2. Description of Related Art

Beachgoers, backpackers, and other recreationalists are frequently required to sit or sleep without traditional furniture while engaging in their recreational activities. The lack of adequate furniture for sitting and sleeping can result in physical discomfort and can detract substantially from the enjoyment of such recreational pursuits. In attempts to alleviate this problem, people engaging in such activities frequently use natural objects such as rocks, logs, or stumps to sit on. Others attempt to improvise by forming beds from sand, various types of tree boughs, leaves, or moss. However, the use of such naturally occurring objects is not completely satisfactory because they are frequently hard and uncomfortable. Further, their use may be harmful to the surrounding environment.

Accordingly, there is a need for comfortable furniture which is compact and lightweight enough to be easily carried during recreational activities. Inflatable furniture, such as the traditional air mattress, has been recognized as compact and lightweight and has gained wide acceptance for sleeping, both among recreationalists and others with similar needs. However, such air mattresses, which are generally rectangular and planar, provide only minimal support and comfort while sitting.

Some air mattresses, such as that described in U.S. Pat. No. 2,623,574 to Damsch, are divided widthwise into three generally rectangular segments separated by foldable hinges. By folding the mattress along the hinges, the segments can be configured to serve as the seat and back of a chair. Tension members are provided to maintain the folded segments in the chair configuration. However, such a configuration is unwieldy and provides only minimal arm and back support.

Other types of inflatable furniture are also known, For example, U.S. Pat. No. 2,982,341 to Besser shows two inflatable bodies which can be configured as a chair. One of the bodies is provided with an aperture extending through the body and serves as a seat. The second body is wrapped partially around the seat to serve as the arms and back of the chair. A tension member extends through the aperture of the seat and is attached to opposite ends of the second body to maintain the two bodies in the chair configuration. However, the two bodies have fairly complex shapes, which complicates manufacturing and increases the expense of such a chair.

U.S Pat. No. 3,584,914 shows a seatless inflatable chair. The chair is generally triangular in shape with a base and two sides. A person sitting in the chair is supported by the sides and base of the chair with the mid portion of their body suspended in the open space between the sides and base. This type of configuration does not provide the support required by some individuals. Further, the chair is bulky and is not designed to function in any capacity other than a chair.

Other types of inflatable furniture, such as those described in U.S. Pat. Nos. 4,459,714 to Lin, 3,576,836 to Khanh, and 3,265,438 to Regan, utilize a number of separate inflatable elements which can be releasably joined in various configurations to serve as mattresses, chairs, or other articles. U.S. Pat. Nos. 3,610,689 to Smith and 3,420,574 to Smith each describe chairs made of both rigid elements and inflatable elements. However, the presence of the rigid elements increases the weight and decreases the portability of the chair.

SUMMARY OF THE INVENTION

Accordingly, it is an object of the present invention to provide a lightweight and compact inflatable cushion which can serve as an article of comfortable furniture and which can be easily stored and transported.

A further object of the invention is to provide an inflatable cushion which is inexpensive and simple to manufacture and easy to assemble.

In another aspect of the invention it is an object of the invention to provide a multifunction inflatable cushion which can serve as either a mattress or a chair.

In accordance with these and other objects, an inflatable cushion in accordance with the present invention comprises an inflatable pillow and an inflatable elongate backing member having opposing first and second ends which may be releasably coupled together. In one aspect of the invention, the cushion is configurable in a first configuration in which the backing member is generally planar to serve as a mattress, and a second configuration in which the first and second ends are coupled to one another to form an enclosure which serves as a chair back and sides. The inflatable pillow may be positioned within the enclosure to form a chair seat.

Other objects and aspects of the invention will become apparent to those skilled in the art from the detailed description of the invention which is presented by way of example and not as a limitation of the present invention.

BRIEF DESCRIPTION OF THE DRAWINGS

FIG. 2*a* shows the inflatable pillow and FIG. 2*b* shows the backing member.

DESCRIPTION OF THE ILLUSTRATED EMBODIMENT

Figure 1:
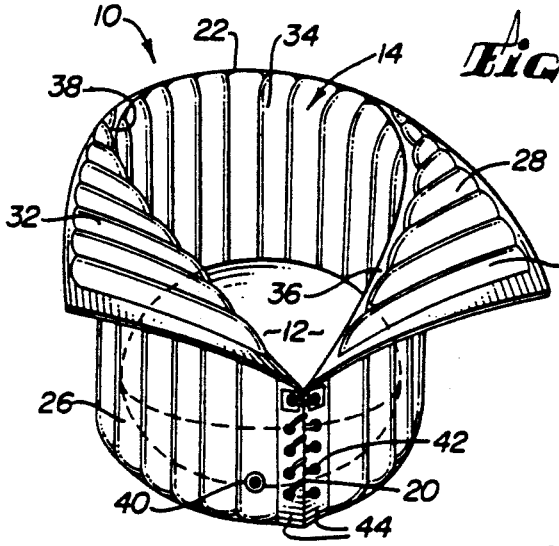
FIG. 1 is an illustration of an inflatable cushion in accordance with a preferred embodiment of the present invention configured as a chair.
Figure 2A:
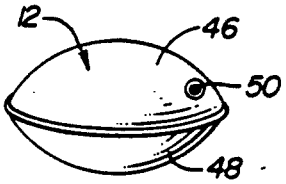
FIGS. 2*a* and 2*b* show the cushion of FIG. 1 in a mattress configuration.

An inflatable cushion in accordance with a preferred embodiment of the present invention is indicated in FIG. 1 as reference numeral 10. The inflatable cushion 10 includes an inflatable pillow 12 and an inflatable backing member 14. In FIG. 1, opposing ends 16 and 18 of the backing member 14 are joined by means of a cord 20 to form an enclosure, and the inflatable pillow 12 is fit snugly within the enclosure to form a chair. In an alternate configuration, shown in FIGS. 2*a* and 2*b*, the backing member 14 is generally planar to form a mattress and the pillow 12 can be used as a head rest.

Figure 2B:
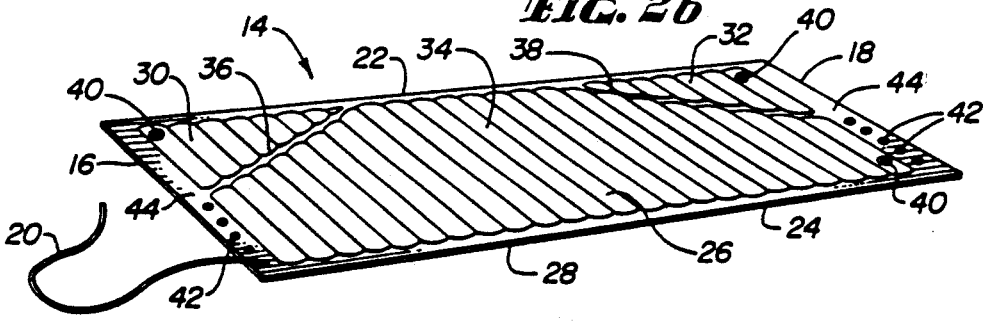

As best seen in FIG. 2*b*, the backing member 14 of the illustrated embodiment is generally rectangular and has a first end 16, a second end 18, a top edge 22, and a bottom edge 24. The backing member 14 is formed of a front sheet 26 and a back sheet 28 made of airtight material and joined in an airtight manner along both ends 16 and 18, the top edge 22, and the bottom edge 24.

In the illustrated embodiment, the backing member is divided into a first arm portion 30, a second arm portion 32, and a backrest portion 34. Each arm portion 30 and 32, is generally triangular. The first arm portion 30 has one edge which extends along the top portion of the first end 16, one edge which extends along a portion of the top edge 22, and a third edge defined by a seam 36. The second arm portion has one edge which extends along the top portion of the second end 18, one edge which extends along a portion of the top edge 22, and a third edge defined by a seam 38. Each seam, 36 and 38, is flexible and forms an air tight seal between the associated arm portions, 30 and 32, and the backrest portion 34.

Each arm portion, 30 and 32, and the backrest portion is provided with an inflation nozzle 40. In this manner, the backing member 14 can be independently inflated to form three separate chambers, one corresponding to each portion 30, 32, and 34. Baffles (not shown, but evidenced by the creases extending across the width of the backing portion) may be interposed between the front sheet and the back sheet in each portion to prevent the chambers from bulging excessively when inflated. In the illustrated embodiment, the baffles, which are of any suitable construction well known in the art, extend across the backing member 14, generally parallel to the ends thereof. This orientation of the baffles facilitates bending of the backing member to form the chair configuration and stiffens the back of the chair to provide firm support for one sitting in the chair.

To allow the opposing ends of the backing member to be releasably coupled, each end of the backing member 14 is provided with a plurality of apertures 42. A cord 20 is provided which can be laced through the apertures 42 to releasably join the opposite ends of the backing member 14 together to form an enclosure. In the illustrated embodiment, the front sheet 26 and the back sheet 28 are sealed together at each end of the backing member 14 to form a flap 44. The apertures 42 are provided along the lower portion of the flap 44 in the vicinity of the backrest portion 34. Reenforcing material or grommets may be used to prevent the apertures from tearing.

The inflatable pillow 12 is formed of a generally circular top sheet 46 and a generally circular bottom sheet 48. The top and bottom sheets 46 and 48 are sealed to one another around their perimeters. The top sheet 46 is provided with an inflation nozzle 50 which can be used to inflate the pillow 12. It may be desirable to provide a baffle structure (not shown) between the top sheet 46 and the bottom sheet 48 to prevent the top and bottom sheets from bulging excessively when the pillow 12 is inflated. Baffles may also help to flatten the top and bottom surface of the pillow to increase the stability of the resulting chair.

In the illustrated embodiment, both the pillow 12 and the backing member 14 are made of polyvinylchloride. However, it should be appreciated that, as long as the material is durable and air tight, a variety of materials well known to those skilled in the art can be used. Similarly the particular method used to join and seal the material can vary depending on the type of material used and the particular preferences of the manufacturer.

As seen in FIG. 2, when the backing member is inflated, it tends to be planar. As such it can serve as a comfortable mattress for recreationalists or others in need of lightweight compact furniture. The pillow can also be used as a head rest.

To form the chair, the opposing ends 16 and 18 of the backing member 14 are laced together by threading the cord 20 through the apertures 42 to form a generally circular enclosure. The pillow 12 is then inserted into the base of the enclosure. The pillow 12 should be sized such that its circumference is at least as large as the inner diameter of the enclosure, i.e., approximately the length of the backing member 14. In this manner, the pillow will fit snugly into the enclosure and friction between the pillow and the backing member will hold the pillow in place. In other embodiments, it may be desirable to provide fasteners to secure the pillow within the enclosure.

Because the ends of the backing member 14 are laced together only in the vicinity of the backrest portion 34, the arm portions 30 and 32 may be folded outward along seams 36 and 38, respectively, as seen in FIG. 1. This allows a user easy access sit on the pillow 12. Folding the arm portions outward also provides additional strength and rigidity to the backrest portion so that the backrest portion can provide firm and comfortable support for the users back.

It should be appreciated that the although the illustrated embodiment shows a cord and apertures for joining the opposing end of the backing member, other methods of joining are also within the scope of the invention. For example, snaps or a zipper could be provided along flap 44. Alternatively, hook and pile fasteners or a variety of other fastening devices could be used. If the cushion is to serve only as a chair, it may be desirable to permanently join the opposing ends of the backing member.

Figure 4:
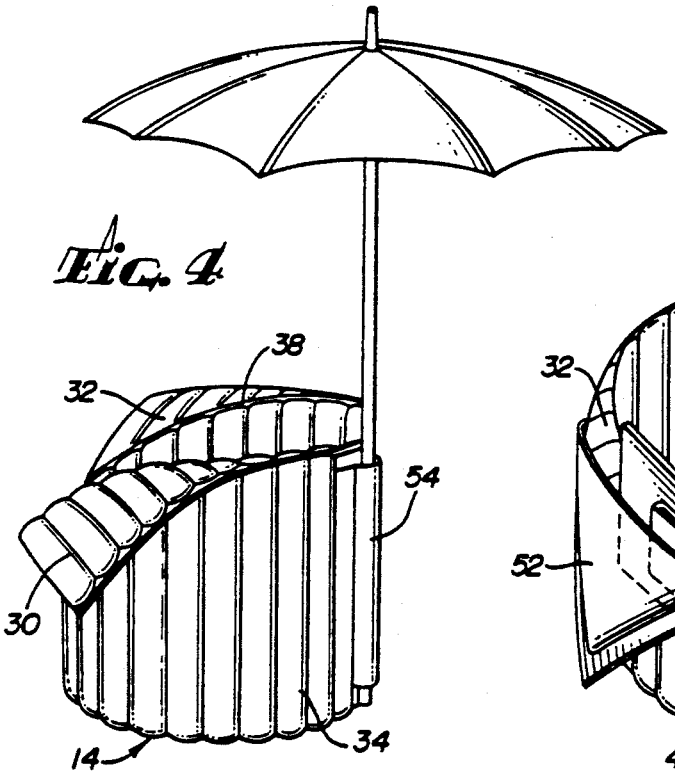
FIG. 4 shows a rear view of the embodiment of FIG. 3.
Figure 3:
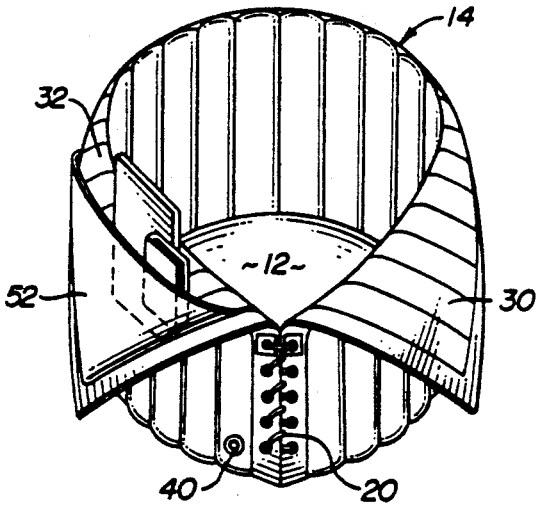
FIG. 3 shows a front view of an alternative embodiment of the inflatable/cushion in the chair configuration.

In an alternative embodiment, illustrated in FIGS. 3 and 4, arm portion 32 is provided with a triangular flap 52 which is joined along the end and top of the arm portion. When the arm portion is folded outward, the flap forms a pocket which can be used to hold reading material, sun screen, and the like. If desired, the arm portions can be deflated, as shown in FIG. 3. In addition, as illustrated in FIG. 4, a sleeve 54 is joined to the top sheet 22 at the midpoint of the backing member 14. When the backing member is in the chair configuration, the sleeve can be used to support an umbrella.

This detailed description is set forth only for purposes of illustrating an example of the present invention and should not be considered to limit the scope thereof in any way. Clearly numerous additions, substitutions, and other modifications can be made to the invention without departing from the scope of the invention which is defined in the appended claims and equivalents thereof.

What is claimed is:

1. An inflatable cushion which can be configured as either a chair or a mattress, said cushion comprising:

an inflatable backing member, said backing member being generally rectangular and having a top edge, a bottom edge, first and second ends, a first arm portion associated with the first end and a second arm portion associated with the second end;

coupling means for releasably coupling the first and second ends to one another to form an enclosure, said first and second ends being adjacent one another along at least a portion of their length when coupled; and an inflatable pillow sized to fit snugly within the enclosure;

wherein in a coupled position the enclosure is a chair back and sides and the inflatable pillow is positionable within the enclosure to form a chair seat, the first and second ends being separable in the region of the first and second arm portions to allow access to the chair seat, and wherein in an uncoupled position the backing member is generally planar to form a mattress.

2. The inflatable cushion of claim 1 wherein the inflatable pillow is generally circular.

3. The inflatable cushion of claim 2 wherein the coupling means comprises a plurality of apertures provided along at least a portion of the first end and the second end and a cord extendable through said apertures to lace the first and second ends together.

4. The inflatable cushion of claim 3 wherein the first and second arm portions are inflatable.

5. The inflatable cushion of claim 4 further comprising a mounting sleeve attached to the back of the elongate member for receiving and supporting an umbrella.

6. An inflatable cushion which can be configured alternately as a chair or a mattress, said cushion comprising:

a rectangular backing member having a top edge, a bottom edge, and two opposing ends, the backing member constructed from a front sheet and a back sheet joined along the top edge, the bottom edge, and the opposing ends, the front and back sheets being impermeable to air and joined in an airtight manner, said backing member having first, second, and third inflatable chambers each sealed from the other two, the first chamber being generally triangular in shape with one edge of the triangle extending along a portion of the first end of the backing member, a second edge of the triangle extending along a portion of the top edge of the backing member, and a third edge being a first seam formed in the backing member, the second chamber being triangular in shape with one edge of the triangle extending along a portion of the second end of the backing member, a second edge of the triangle extending along a portion of the top edge of the backing member, and a third edge of the triangle being a second seam formed in the backing member, said backing member being provided with a plurality of apertures formed along the opposing ends, said apertures being sealed from the three chambers;

a cord associated with the apertures, said cord being laceable through said apertures to releasably couple the first end to the second end to form an enclosure;

an inflatable pillow formed of a top sheet and a bottom sheet of air tight material joined in an air tight seal, said pillow having a generally circular shape dimensioned to fit snugly within the enclosure when the first and second ends are coupled;

wherein said cushion has a chair configuration in which the first and second ends are coupled, the pillow is situated within the enclosure near bottom edge, and the first and second portions are separated by folding them outward along the first and second seams to allow access to the pillow, and a mattress configuration in which the first and second ends are uncoupled and the backing member is positioned in a generally planar manner.

7. The inflatable cushion of claim 6 further comprising system of baffles interposed between the top and bottom sheets of the backing member to maintain the top and bottom sheets in a relatively uniform spacing when the backing member is inflated, said baffles being generally parallel to the ends of the backing member.

* * * * *